US010597599B2

(12) United States Patent
Knapton et al.

(10) Patent No.: US 10,597,599 B2
(45) Date of Patent: Mar. 24, 2020

(54) NITROGEN-FUNCTIONALIZED OLEFIN POLYMERS FOR ENGINE LUBRICANTS

(71) Applicant: The Lubrizol Corporation, Wickliffe, OH (US)

(72) Inventors: Daniel J. Knapton, Willowick, OH (US); Ewan E. Delbridge, Concord Township, OH (US); Matthew D. Gieselman, Wickliffe, OH (US); Jack C. Kelley, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 87 days.

(21) Appl. No.: 16/063,303

(22) PCT Filed: Nov. 17, 2016

(86) PCT No.: PCT/US2016/062429
§ 371 (c)(1),
(2) Date: Jun. 18, 2018

(87) PCT Pub. No.: WO2017/105747
PCT Pub. Date: Jun. 22, 2017

(65) Prior Publication Data

US 2018/0371357 A1 Dec. 27, 2018

Related U.S. Application Data

(60) Provisional application No. 62/269,579, filed on Dec. 18, 2015.

(51) Int. Cl.

| | |
|---|---|
| ***C10M 169/04*** | (2006.01) |
| ***C10M 167/00*** | (2006.01) |
| ***C10M 149/18*** | (2006.01) |
| ***C10M 135/10*** | (2006.01) |
| ***C10M 149/22*** | (2006.01) |

(52) U.S. Cl.
CPC ..... *C10M 169/044* (2013.01); *C10M 135/10* (2013.01); *C10M 149/18* (2013.01); *C10M 149/22* (2013.01); *C10M 167/00* (2013.01); *C10M 2203/003* (2013.01); *C10M 2203/1006* (2013.01); *C10M 2215/086* (2013.01); *C10M 2217/024* (2013.01); *C10M 2217/046* (2013.01); *C10M 2217/06* (2013.01); *C10M 2219/046* (2013.01); *C10N 2220/022* (2013.01); *C10N 2230/02* (2013.01); *C10N 2230/04* (2013.01); *C10N 2230/08* (2013.01); *C10N 2230/52* (2013.01); *C10N 2240/102* (2013.01); *C10N 2240/103* (2013.01); *C10N 2240/104* (2013.01)

(58) Field of Classification Search
CPC ..... C10M 169/044; C10M 167/00; C10M 149/22; C10M 149/18; C10M 135/10; C10M 2203/1006; C10M 2217/024; C10M 2215/086; C10M 2217/06; C10M 2217/046; C10M 2203/003; C10M 2219/046; C10N 2220/022; C10N 2240/103; C10N 2240/102; C10N 2230/08; C10N 2240/104; C10N 2230/52; C10N 2230/04; C10N 2230/02
See application file for complete search history.

(56) References Cited

U.S. PATENT DOCUMENTS

| | | | | |
|---|---|---|---|---|
| 5,314,632 | A | 5/1994 | Papke et al. | |
| 5,614,124 | A * | 3/1997 | Esche, Jr. | C10M 141/08 508/251 |
| 6,117,825 | A | 9/2000 | Liu et al. | |
| 6,117,826 | A * | 9/2000 | Baranski | C07C 333/20 508/363 |
| 6,790,813 | B2 * | 9/2004 | Boffa | C10M 163/00 508/198 |
| 7,790,661 | B2 | 9/2010 | Covitch et al. | |
| 2007/0293409 | A1 * | 12/2007 | Kolp | C08F 210/10 508/545 |
| 2010/0190668 | A1 * | 7/2010 | Hishinuma | C10M 169/02 508/182 |
| 2011/0306528 | A1 * | 12/2011 | Gieselman | C10M 133/52 508/261 |
| 2012/0012076 | A1 * | 1/2012 | Atkinson | C10M 169/04 123/1 A |
| 2013/0237465 | A1 * | 9/2013 | Andoh | C10M 171/02 508/507 |
| 2014/0378355 | A1 * | 12/2014 | Matsui | C10M 135/18 508/186 |

FOREIGN PATENT DOCUMENTS

| | | |
|---|---|---|
| WO | 2009/064685 A2 | 5/2009 |
| WO | 2015/088769 A2 | 6/2015 |

* cited by examiner

*Primary Examiner* — Pamela H Weiss
(74) *Attorney, Agent, or Firm* — Michael Miller; David Shold

(57) ABSTRACT

A lubricant composition of an oil of lubricating viscosity, an ashless condensation reaction product of an olefin polymer, having a number average molecular weight of 2,000 to 70,000, comprising carboxylic acid or equivalent functionality grafted onto the polymer backbone, with a monoamine or a polyamine often having a single primary amino group; a succinimide dispersant; and an overbased metal detergent, in an amount such that the total base number of the lubricant composition is less than 6.5, exhibits good sludge prevention performance in a gasoline engine.

16 Claims, No Drawings

NITROGEN-FUNCTIONALIZED OLEFIN POLYMERS FOR ENGINE LUBRICANTS

CROSS REFERENCE TO RELATED APPLICATION

This application claims priority from PCT Application Serial No. PCT/US2016/062429 filed on Nov. 17, 2016, which claims the benefit of U.S. Provisional Application No. 62/269,579 filed on Dec. 18, 2015, both of which are incorporated in their entirety by reference herein.

BACKGROUND

The disclosed technology relates to a lubricant for an internal combustion engine comprising, among other components, a nitrogen-functionalized olefin polymer.

Lubricants for internal combustion engines, such as spark-ignited engines for passenger cars, must meet demanding performance requirements. They must lubricate the engine to prevent wear and minimize friction, while being resistant to degradation and deterioration in performance arising from contact with combustion byproducts and other contaminants. In particular, it remains a challenge to provide lubricants that do not deteriorate over time by formation of sludge, varnish, or other deposits; this is often accomplished, at least in part, by including in the lubricant nitrogen-containing dispersants such as succinimide dispersants. It is also desirable that the lubricant should be resistant to deleterious effects arising from the presence of water, which may arise as a product of combustion of the fuel within the engine. The technology disclosed herein permits formulation with reduced amounts of nitrogen-containing succinimide dispersant while retaining good sludge and deposit prevention performance and providing good water tolerance.

U.S. Pat. No. 7,790,661, Covitch et al., Sep. 7, 2010, discloses dispersant viscosity modifiers containing aromatic amines. There is disclosed the reaction product of a polymer comprising carboxylic acid functionality or a reactive equivalent thereof, said polymer having a number average molecular weight of greater than 5,000, and an amine component comprising 3-nitroaniline. The aromatic amine can also be an N,N-dialkylphenylenediamine such as N,N-dimethyl-1,4,-phenylenediamine. Suitable backbone polymers include ethylene propylene copolymers. An ethylenically unsaturated carboxylic acid material is typically grafted onto the polymer backbone. Maleic anhydride or a derivative thereof is suitable. Conventional lubricant additives may also be present, including additional dispersants, detergents, and other materials. The derivatized graft copolymer can be employed in crankcase lubricating oils for spark-ignited and compression-ignited internal combustion engines.

U.S. Publication 2010/0162981, Adams et al., Jul. 1, 2010, discloses a multigrade lubricating oil composition with enhanced antiwear properties for use in an internal combustion engine, preferably a diesel engine. The lubricant comprises a base oil, one or more dispersant viscosity modifiers in a total amount of 0.15 to 0.8% by weight, one or more dispersants in a total amount of active dispersants of 1.5 to 3% by weight, one or more detergents, and one or more metal dihydrocarbyl dithiophosphates. An example of a suitable dispersant viscosity modifier is a co-polymer of ethylene-propylene grafted with an active monomer, for example maleic anhydride and then derivatized with an alcohol or amine. A suitable dispersant modifier is that present in Lubrizol's LZ 7177B.

U.S. Pat. No. 5,264,140, Mishra et al., discloses a lubricating oil composition comprising a major amount of a base oil and a minor amount of, as an antioxdant/dispersant VI improver additive, a lubricant additive. Disclosed is a polymer prepared from ethylene and propylene; an ethylenically unsaturated carboxylic acid material is grafted onto the polymer backbone. Maleic anhydride grafted polyisobutylene may also be used. The intermediate is reacted with an amino aromatic compound.

U.S. Publication 2009/0176672, Goldblatt, Jul. 9, 2009, discloses functional monomers for grafting to low molecular weight polyalkenes and their use in preparation of dispersants and lubricating oil compositions. The polyalkene may have an average molecular weight range of about 300 to about 10,000.

U.S. Publication 2011/0245119, Sauer, Oct. 6, 2011, discloses multiple function graft polymers useful as dispersants, suitable for controlling sludge, varnish, soot, friction, and wear. The polymer may have a molecular weight of from about 10,000 to about 500,000. A graftable coupling group may undergo condensation reaction with an amine. The products are said to be useful for internal combustion engines. The lubricants optionally may contain about 0.1 to about 10% of one or more detergents, preferably 0.5 to 4%.

SUMMARY

The disclosed technology provides a lubricant composition comprising an oil of lubricating viscosity having a kinematic viscosity at 100° C. of 2 to 6 $mm^2 s^{-1}$ or to 5.3 $mm^2 s^{-1}$; 0.14 to 1.5, or 0.25 to 1.5 percent by weight of an ashless condensation reaction product of an olefin polymer, having a number average molecular weight (gel permeation chromatography, GPC) of 2,000 to 70,000, or 5,000 to 65,000, comprising carboxylic acid functionality or a reactive equivalent thereof grafted onto the polymer backbone, with a monoamine or a polyamine provided that if the olefin polymer is an ethylene/propylene copolymer, then said polyamine is not a poly(ethyleneamine); 0.35 to 1.8 percent by weight of a succinimide dispersant comprising the condensation product of a polyolefin-substituted succinic anhydride, with an alkylene polyamine, where the polyolefin substituent has a number average molecular weight of 1,000 to 3,500; and 0.05 to 1.5 percent by weight of an overbased metal detergent, in an amount such that the total base number (TBN per ASTM D2896) of the lubricant composition is less than 6.5; said lubricant composition having a high-temperature high-shear viscosity per ASTM D4683 of 1.4 to 3.5 mPa-s (cP).

In other embodiments the disclosed technology provides a method for lubricating a spark-ignited, sump-lubricated internal combustion engine using the disclosed lubricant composition; and a method for improving the water resistance of a lubricating oil as described herein, comprising including within said lubricating oil 0.25 to 1.5 percent by weight of the condensation reaction product of an olefin copolymer as described above.

DETAILED DESCRIPTION

Various preferred features and embodiments will be described below by way of non-limiting illustration.

One component of the disclosed technology is an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment. Refined oils are similar to the unrefined oils except they have been further treated in one or more purification steps to improve one or more properties.

Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Other synthetic lubricating oils include polyol esters (such as Priolube® 3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines (2011). The five base oil groups are as follows: Group I (sulfur content >0.03 wt %, and/or <90 wt % saturates, viscosity index 80 to less than 120); Group II (sulfur content ≤0.03 wt %, and ≥90 wt % saturates, viscosity index 80 to less than 120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions," fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. The polyalphaolefin may be prepared by metallocene catalyzed processes or from a non-metallocene process. The oil of lubricating viscosity may also comprise an API Group I, Group II, Group III, Group IV, Group V oil or mixtures thereof. Often the oil of lubricating viscosity is an API Group I, Group II, Group II+, Group III, Group IV oil or mixtures thereof. Alternatively the oil of lubricating viscosity is often an API Group II, Group II+, Group III or Group IV oil or mixtures thereof. Alternatively the oil of lubricating viscosity is often an API Group II, Group II+, Group III oil or mixtures thereof.

The oil of lubricating viscosity, or base oil, will overall have a kinematic viscosity at 100° C. of 2 to 6 $mm^2 s^{-1}$ or, in some embodiments 2.2 to 5.3 or to 5 $mm^2 s^{-1}$, as measured by ASTM D445. Proper selection of the viscosity of the base oil may be a significant factor in formulating a lubricant to the required level of high temperature high shear (HTHS) viscosity, as described in greater detail below.

The amount of the oil of lubricating viscosity present is typically the balance remaining after subtracting from 100 wt % the sum of the amount of the additive as described herein above, and the other performance additives. Illustrative amounts may include 50 to 99 percent by weight, or 60 to 98, or 70 to 95, or 80 to 94, or 85 to 93 percent.

The lubricating composition may be in the form of a concentrate and/or a fully formulated lubricant. If the lubricating composition of the invention is in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

Another component is an ashless condensation reaction product of an olefin polymer with grafted carboxylic acid (or equivalent) functionality, reacted with a monoamine or a polyamine which may have a single primary amino group. If the olefin polymer is an ethylene/propylene copolymer, then said polyamine is not a poly(ethyleneamine). This material may be referred to as a dispersant viscosity modifier, because the olefin polymer may serve to impart viscosity modifier performance and the reacted amine may provide nitrogen or other polar functionality that may impart dispersant performance. Various dispersant viscosity modifiers have been used in the lubrication of heavy-duty diesel engines, where they perform the role of dispersing soot arising from the combustion of the diesel fuel. Gasoline (spark-ignited) engines generally do not generate soot and thus such dispersant viscosity modifiers would not be used in gasoline engines for the dispersion of soot. The use of the present dispersant viscosity modifiers in a non-sooted engine environment permits reduction in the amount of conventional dispersant, such as succinimide dispersant, while retaining dispersant performance and permitting greater flexibility in formulation of the lubricant composition to meet performance targets.

The polymer or copolymer substrate employed in the derivatized graft copolymer will contain grafted carboxylic acid functionality or a reactive equivalent of carboxylic acid functionality (e.g., anhydride or ester). The reactive carboxylic acid functionality will typically be present as a pendant group attached by, for instance, a grafting process. The olefin polymer may be derived from isobutylene or isoprene. In certain embodiments, the polymer may be prepared from ethylene and propylene or it may be prepared from ethylene and a higher olefin within the range of ($C_3$-$C_{10}$) alpha-monoolefins, in either case grafted with a suitable carboxylic acid-containing species (i.e., monomer).

More complex polymer substrates, often designated as interpolymers, may be prepared using a third component. The third component generally used to prepare an interpolymer substrate may be a polyene monomer selected from conjugated or non-conjugated dienes and trienes. The non-conjugated diene component may be one having from about 5 to about 14 carbon atoms. The diene monomer may be characterized by the presence of a vinyl group in its structure and can include cyclic and bicyclo compounds.

Representative dienes include 1,4-hexadiene, 1,4-cyclohexadiene, dicyclopentadiene, 5-ethylidene-2-norbornene, 5-methylene-2-norbornene, 1,5-heptadiene, and 1,6-octadiene. A mixture of more than one diene can be used in the preparation of the interpolymer.

The triene component may also be present, which will have at least two non-conjugated double bonds and up to about 30 carbon atoms. Typical trienes include 1-isopropylidene-3a,4,7,7a-tetrahydroindene, 1-isopropylidenedicyclopentadiene, and 2-(2-methylene-4-methyl-3-pentenyl)-[2.2.1] bicyclo-5-heptene.

Suitable backbone polymers of the olefin polymer variety include ethylene propylene copolymers, ethylene-propylene-alpha olefin terpolymers, ethylene-alpha olefin copolymers, ethylene propylene copolymers further containing a non-conjugated diene, and isobutylene/conjugated diene copolymers, each of which can be subsequently supplied with grafted carboxylic functionality.

The polymerization reaction to form the olefin polymer substrate may be carried out in the presence of a catalyst in a solvent medium. The polymerization solvent may be any suitable inert organic solvent that is liquid under reaction conditions for solution polymerization of monoolefins, which can be conducted in the presence of a Ziegler-Natta type catalyst or a metallocene catalyst. In a typical preparation of a polymer substrate, hexane is first introduced into a reactor and the temperature in the reactor is raised moderately to about 30° C. Dry propylene is fed to the reactor until the pressure reaches about 130-150 kPa above ambient (40-45 inches of mercury). The pressure is then increased to about 200 kPa (60 inches of mercury) by feeding dry ethylene and 5-ethylidene-2-norbornene to the reactor. The monomer feeds are stopped and a mixture of aluminum sesquichloride and vanadium oxytrichloride is added to initiate the polymerization reaction. Completion of the polymerization reaction is evidenced by a drop in the pressure in the reactor.

Ethylene-propylene or higher alpha monoolefin copolymers may consist of 15 to 80 mole % ethylene and 20 to 85 mole % propylene or higher monoolefin, in some embodiments, the mole ratios being 30 to 80 mole % ethylene and 20 to 70 mole % of at least one $C_3$ to $C_{10}$ alpha monoolefin, for example, 50 to 80 mole % ethylene and 20 to 50 mole % propylene. Terpolymer variations of the foregoing polymers may contain up to 15 mole % of a non-conjugated diene or triene.

In these embodiments, the polymer substrate, such as the ethylene copolymer or terpolymer, can be an oil-soluble, substantially linear, rubbery material. Also, in certain embodiments the polymer can be in forms other than substantially linear, that is, it can be a branched polymer or a star polymer. The polymer can also be a random copolymer or a block copolymer, including di-blocks and higher blocks, including tapered blocks and a variety of other structures. These types of polymer structures are known in the art and their preparation is within the abilities of the person skilled in the art.

The terms polymer and copolymer are used generically to encompass ethylene and/or higher alpha monoolefin polymers, copolymers, terpolymers or interpolymers. These materials may contain minor amounts of other olefinic monomers so long as their basic characteristics are not materially changed.

The polymer of the disclosed technology may have a number average molecular weight (by gel permeation chromatography, polystyrene standard), which can typically be 2,000 to 75,000, 4,000 to 65,000, 5,000 to 65,000, or 9,000 to 55,000, or 11,000 to 52,000, or 40,000 to 50,000.

An ethylenically unsaturated carboxylic acid material is typically grafted onto the polymer backbone. These materials which are attached to the polymer typically contain at least one ethylenic bond (prior to reaction) and at least one, such as two, carboxylic acid (or its anhydride) groups or a polar group which is convertible into said carboxyl groups by oxidation or hydrolysis. Maleic anhydride or a derivative thereof is suitable. It grafts onto the olefin polymer, (e.g., ethylene copolymer or terpolymer) to give two carboxylic acid functionalities. Examples of additional unsaturated carboxylic materials include chlormaleic anhydride, itaconic anhydride, or the corresponding dicarboxylic acids, such as maleic acid, fumaric acid and their esters, as well as cinnamic acid and esters thereof.

The ethylenically unsaturated carboxylic acid material may be grafted onto the polymer (such as the ethylene/propylene copolymer) in a number of ways. It may be grafted onto the polymer in solution or in molten form with or without using a radical initiator. The free-radical induced grafting of ethylenically unsaturated carboxylic acid materials may also be conducted in solvents, such as hexane or mineral oil. It may be carried out at an elevated temperature in the range of 100° C. to 250° C., e.g., 120° C. to 190° C., or 150° C. to 180° C., e.g., above 160° C. If it is conducted in a solvent such as a mineral lubricating oil solution, the solution may contain, e.g., 1 to 50 wt. %, or 5 to 30 wt. %, based on the initial total oil solution, of the ethylene/propylene copolymer.

The free-radical initiators which may be used include peroxides, hydroperoxides, and azo compounds, typically those which have a boiling point greater than about 100° C. and which decompose thermally within the grafting temperature range to provide free radicals. Representative of these free-radical initiators include azobisisobutyronitrile and 2,5-dimethyl-hex-3-yne-2,5-bis-tertiary-butyl peroxide. The initiator may be used in an amount of 0.005% to 1% by weight based on the weight of the reaction mixture solution. The grafting may be carried out in an inert atmosphere, such as under nitrogen blanketing. The resulting polymer intermediate is characterized by having carboxylic acid acylating functions within its structure.

In a melt process for forming a graft polymer, with the optional use of a radical initiator, the unsaturated carboxylic acid may be grafted onto molten rubber using rubber masticating or shearing equipment. The temperature of the molten material in this process may be 150° C. to 400° C. Optionally, as a part of this process or separate from this process, mechanical shear and elevated temperatures can be used to reduce the molecular weight of the polymer to a value that will eventually provide the desired level of shear stability for the lubricant application. In one embodiment, such mastication can be done in a twin screw extruder properly configured to provide high shear zones, capable of breaking down the polymer to the desired molecular weight. Shear degradation can be done before or after grafting with the maleic anhydride. It can be done in the absence or presence of oxygen. The shearing and grafting steps can be done in the same extruder or in separate extruders, in any order.

In an alternative embodiment, the unsaturated carboxylic acid material, such as maleic anhydride, can be first condensed with a monoamine or polyamine, typically having a single primary amino group (described below) and the condensation product itself then grafted onto the polymer backbone in analogous fashion to that described above.

In another alternative embodiment, the condensation product can be formed by the reaction of the monoamine or polyamine with the unsaturated carboxylic acid material in an extruder.

The carboxylic acid functionality can also be provided by a graft process with glyoxylic acid or its homologues or a reactive equivalent thereof of the general formula $R^3C(O)(R^4)_nC(O)OR^5$. In this formula $R^3$ and $R^5$ are hydrogen or hydrocarbyl groups and $R^4$ is a divalent hydrocarbylene group. n is 0 or 1. Also include are the corresponding acetals, hemiacetals, ketals, and hemiketals. Preparation of grafts of such glyoxylic materials onto hydrocarbon-based polymers is described in detail in U.S. Pat. No. 6,117,941.

The amount of the reactive carboxylic acid on the polymer chain, and in particular the amount of grafted carboxylic acid on the chain is typically 0.5 to 6 weight percent, or 1 to 5 weight percent, or 2 to 3 weight percent, based on the weight of the polymer backbone. These numbers represent the amount of carboxylic-containing monomer with particular reference to maleic anhydride as the graft monomer. The amounts may be adjusted to account for acid monomers having higher or lower molecular weights or greater or lesser amounts of acid functionality per molecule, as will be apparent to the person skilled in the art. The grafting may be of an extent to provide an acid functionalized polymer having a total acid number (TAN per ASTM D664) of 10 to 50, or 20 to 40, or 25 to 35, or about 31.

The acid-containing polymer is reacted with a monoamine or a polyamine typically having a single primary amino group. If the olefin polymer is an ethylene/propylene copolymer, then said polyamine is not a poly(ethyleneamine). The reaction may consist of condensation to form an imide, amide, or half-amide or amide-ester (assuming a portion of alcohol is also reacted) or an amine salt. A primary amino group will typically condense to form an amide or, in the case of maleic anhydride monomer, an imide. It is noted that in certain embodiments the amine will have a single primary amino group, that is, it will not have two or more primary amino groups (except perhaps a very small an inconsequential amount of additional primary amino groups within the entire amine component, e.g., less than 5% or 2% or 1% or 0.5%, or 0.01 to 0.1%, especially 1% or less, such as 0.01 to 1%, of amine groups being primary). This feature will minimize the amount of crosslinking that might otherwise occur. Poly(ethyleneamine)s may generally, and in an oversimplified manner, be depicted as $H_2N—(C_2H_4—NH—)_n—C_2H_4—NH_2$, where n may be, for instance, 2 through 6. These typically have on average about 2 primary amino groups, so their use is typically undesirable for functionalization of ethylene/propylene copolymers, so that any undesirable crosslinking may be minimized or avoided. In those embodiments in which the polyamine is not a poly(ethyleneamine), the amine component employed to make the condesnation product will be free of or substantially free of poly(ethyleneamine), such as less than 5 percent by weight of the amine component is poly(ethyleneamine), or less than 1 percent, or 0.01 to 0.1 percent by weight.

Suitable primary amines may include aromatic amines, such as amines wherein a carbon atom of the aromatic ring structure is attached directly to the amino nitrogen. The amines may be monoamines or polyamines. The aromatic ring will typically be a mononuclear aromatic ring (i.e., one derived from benzene) but can include fused aromatic rings, such as those derived from naphthalene. Examples of aromatic amines include aniline, N-alkylanilines such as N-methyl aniline, and N-butylaniline, di-(paramethylphenyl)amine, naphthylamine, 4-aminodiphenylamine, N,N-dimethylphenylenediamine, 4-(4-nitrophenylazo)aniline (disperse orange 3), sulfamethazine, 4-phenoxyaniline, 3-nitroaniline, 4-aminoacetanilide, 4-amino-2-hydroxy-benzoic acid phenyl ester (phenyl amino salicylate), N-(4-amino-5-methoxy-2-methyl-phenyl)-benzamide (fast violet B), N-(4-amino-2,5-dimethoxy-phenyl)-benzamide (fast blue RR), N-(4-amino-2,5-diethoxy-phenyl)-benzamide (fast blue BB), N-(4-amino-phenyl)-benzamide and 4-phenylazoaniline. Other examples include para-ethoxyaniline, para-dodecylaniline, cyclohexyl-substituted naphthylamine, and thienyl-substituted aniline. Examples of other suitable aromatic amines include amino-substituted aromatic compounds and amines in which an amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide (i.e., $\phi$-NH-$\phi$-NH—$COCH_2CH(CH_3)NH_2$). Additional aromatic amines include aminocarbazoles, aminoindoles, aminopyrroles, amino-indazolinones, aminoperimidines, mercaptotriazoles, aminophenothiazines, aminopyridiens, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl) amino} butanamide. Other aromatic amines which can be used include various aromatic amine dye intermediates containing multiple aromatic rings linked by, for example, amide structures. Examples include materials of the general structure $\phi$-CONH-$\phi$-$NH_2$ where the phenyl groups may be substituted. Suitable aromatic amines include those in which the amine nitrogen is a substituent on an aromatic carboxylic compound, that is, the nitrogen is not $sp^2$ hybridized within an aromatic ring.

Aliphatic or cycloaliphatic amines include monoamines having, e.g., 1 to 8 carbon atoms, such as methylamine, ethylamine, and propylamine, as well as various higher amines. Aliphatic diamines or polyamines can also be used, and typically will have only a single primary amino group. Examples include dimethylaminopropylamine, diethylaminopropylamine, dibutylaminopropylamine, dimethylaminoethylamine, diethylaminoethylamine, dibutylaminoethylamine, 1-(2-aminoethyl)piperidine, 1-(2-aminoethyl) pyrrolidone, aminoethylmorpholine, and aminopropylmorpholine.

In certain embodiments aromatic amines can be used alone or in combination with each other or in combination with aliphatic or cycloaliphatic amines. The amount of such an aliphatic or cycloaliphatic amine may, in some embodiments, be a minor amount compared with the amount of the aromatic amine.

In one embodiment that amine component comprises a monoamine. In one embodiment the amine component contains a single aromatic ring, and in one embodiment the amine component comprises 3-nitroaniline. If the amine component comprises an aromatic amine, in certain embodiments the grafted olefin polymer may be further condensed with an aliphatic amine. In one embodiment the amine component may comprise an amine containing one or more ether linkages, i.e., an ether amine or a polyetheramine. Polyetheramines and their methods of preparation are described in greater detail in U.S. Pat. No. 6,458,172, columns 4 and 5.

In certain embodiments the grafted olefin polymer may have a nitrogen content of 0.4 to 1.6 percent by weight, or 0.2 to 3, or 0.3 to 2, or 0.4 to 1.6, or 0.5 to 1.4, or 0.85 to 2 percent by weight. The amount of the condensation reaction product of the olefin polymer may be 0.14 to 1.5, or 0.25 to 1.5, or 0.25 to 1, or 0.4 to 1 percent by weight.

Lubricants as disclosed herein will also contain one or more succinimide dispersants in an amount (total) of 0.35 to 1.8 weight percent, or 0.5 to 1.5, or 1 to 1.45 percent. These amounts are significantly less than the amounts that have hithertofore been required, which may be 2 to 4 percent or more for conventional gasoline engine lubricants and 3 to 5 percent or more for diesel engine lubricants. Succinimide dispersants are known. Succinimide dispersants include N-substituted long chain alkenyl succinimides, having a variety of chemical structures including typically

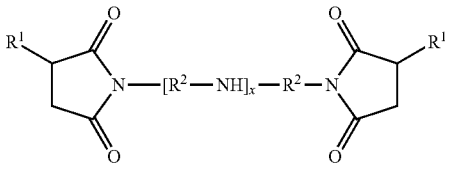

where each $R^1$ is independently an alkyl group, frequently a polyisobutylene group, and the $R^1$ groups may have a number average molecular weight ($M_n$) of 1000 to 3,500. The $R^2$ groups are alkylene groups, commonly ethylene ($C_2H_4$) groups. The $M_n$ of the $R^1$ groups may alternatively be 1500 to 3000 or 2800 to 2500. Such molecules are commonly derived from reaction of an alkenyl acylating agent with a polyamine, and a wide variety of linkages between the two moieties is possible beside the simple imide structure shown above, including a variety of amides and quaternary ammonium salts. In the above structure, the amine portion is shown as an alkylene polyamine, although other aliphatic and aromatic mono- and polyamines may also be used. Also, a variety of modes of linkage of the $R^1$ groups onto the imide structure are possible, including various cyclic linkages. The ratio of the carbonyl groups of the acylating agent to the nitrogen atoms of the amine may be 1:0.5 to 1:3, and in other instances 1:1 to 1:2.75 or 1:1.5 to 1:2.5. Succinimide dispersants are more fully described in U.S. Pat. Nos. 4,234,435 and 3,172,892 and in EP 0355895. Succinimides made by the so-called conventional (or chlorine) route as well as by the thermal or direct alkylation or "ene" route are included, as disclosed in the above patent documents. Succinimide dispersants made by the different routes will typically be characterized by differences in the detailed structures whereby the $R^1$ groups are attached. Dispersants may also be post-treated with various agents such as borating agents (e.g., boric acid) to make borated dispersants.

TBN of the dispersant will depend on the amount of amine functionality contained therein, and may be 10 to 60 or 12-50 or 15-40 or 20-35 or 35-30. Other embodiments may include 10 to 30 or 12 to 25; or alternatively 20 to 60 or 30 to 50 mg KOH/g (all calculated on an oil-free basis).

Succinimide dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The lubricant formulations disclosed herein will also contain at least one overbased metal detergent. Overbased detergents are generally homogeneous Newtonian systems having by a metal content in excess of that which would be present for neutralization according to the stoichiometry of the metal and the detergent anion. The amount of excess metal is commonly expressed in terms of metal ratio, that is, the ratio of the total equivalents of the metal to the equivalents of the acidic organic compound. Overbased materials are prepared by reacting an acidic material (such as carbon dioxide) with an acidic organic compound, an inert reaction medium (e.g., mineral oil), a stoichiometric excess of a metal base, and a promoter such as a phenol or alcohol. The acidic organic material will normally have a sufficient number of carbon atoms, to provide oil-solubility.

Overbased detergents may be characterized by Total Base Number (TBN, ASTM D2896), the amount of strong acid needed to neutralize all of the material's basicity, expressed as mg KOH per gram of sample. Since overbased detergents are commonly provided in a form which contains diluent oil, for the purpose of this document, TBN is to be recalculated to an oil-free basis by dividing by the fraction of the detergent (as supplied) that is not oil. Some useful detergents may have a TBN of 100 to 800, or 150 to 750, or, 400 to 700.

The metal compounds useful in making the basic metal salts are generally any Group 1 or Group 2 metal compounds (CAS version of the Periodic Table of the Elements). Examples include alkali metals such as sodium, potassium, lithium, copper, magnesium, calcium, barium, zinc, and cadmium. In one embodiment the metals are sodium, magnesium, or calcium; or calcium or magnesium; or calcium. The anionic portion of the salt can be hydroxide, oxide, carbonate, borate, or nitrate.

In one embodiment the lubricant can contain an overbased sulfonate detergent. Suitable sulfonic acids include sulfonic and thiosulfonic acids, including mono- or polynuclear aromatic or cycloaliphatic compounds. Certain oil-soluble sulfonates can be represented by $R^2$-T-$(SO_3^-)_a$ or $R^3$—$(SO_3^-)_b$, where a and b are each at least one; T is a cyclic nucleus such as benzene or toluene; $R^2$ is an aliphatic group such as alkyl, alkenyl, alkoxy, or alkoxyalkyl; ($R^2$)-T typically contains a total of at least 15 carbon atoms; and $R^3$ is an aliphatic hydrocarbyl group typically containing at least 15 carbon atoms. The groups T, $R^2$, and $R^3$ can also contain other inorganic or organic substituents. In one embodiment the sulfonate detergent may be a predominantly linear alkylbenzenesulfonate detergent having a metal ratio of at least 8 as described in paragraphs [0026] to [0037] of US Patent Application 2005065045. In some embodiments the linear alkyl group may be attached to the benzene ring anywhere along the linear chain of the alkyl group, but often in the 2, 3 or 4 position of the linear chain, and in some instances predominantly in the 2 position.

Another overbased material is an overbased phenate detergent. The phenols useful in making phenate detergents can be represented by $(R^1)_a$—Ar—$(OH)_b$, where $R^1$ is an aliphatic hydrocarbyl group of 4 to 400 or 6 to 80 or 6 to 30 or 8 to 25 or 8 to 15 carbon atoms; Ar is an aromatic group such as benzene, toluene or naphthalene; a and b are each at least one, the sum of a and b being up to the number of displaceable hydrogens on the aromatic nucleus of Ar, such as 1 to 4 or 1 to 2. There is typically an average of at least 8 aliphatic carbon atoms provided by the $R^1$ groups for each phenol compound. Phenate detergents are also sometimes provided as sulfur-bridged species.

Alkylphenols are often used as constituents in and/or building blocks for overbased detergents. Alkylphenols may be used to prepare phenate, salicylate, salixarate, or saligenin detergents or mixtures thereof. Suitable alkylphenols may include para-substituted hydrocarbyl phenols. The hydrocarbyl group may be linear or branched aliphatic groups of 1 to 60 carbon atoms, 8 to 40 carbon atoms, 10 to 24 carbon atoms, 12 to 20 carbon atoms, or 16 to 24 carbon atoms. In one embodiment, the alkylphenol overbased detergent is prepared from an alkylphenol or mixture thereof that is free of or substantially free of (i.e. contains less than 0.1 weight percent) p-dodecylphenol. In one embodiment, the lubricating composition of the invention contains less than 0.3 weight percent of alkylphenol, less than 0.1 weight percent of alkylphenol, or less than 0.05 weight percent of alkylphenol.

In one embodiment, the overbased material is an overbased saligenin detergent. Overbased saligenin detergents are commonly overbased magnesium salts which are based on saligenin derivatives. A general example of such a saligenin derivative can be represented by the formula

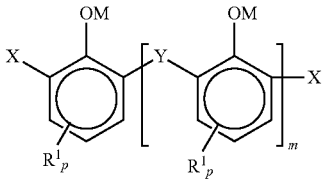

where X is —CHO or —$CH_2OH$, Y is —$CH_2$— or —$CH_2OCH_2$—, and the —CHO groups typically comprise at least 10 mole percent of the X and Y groups; M is hydrogen, ammonium, or a valence of a metal ion (that is, if M is multivalent, one of the valences is satisfied by the illustrated structure and other valences are satisfied by other species such as anions or by another instance of the same structure), $R_1$ is a hydrocarbyl group of 1 to 60 carbon atoms, m is 0 to typically 10, and each p is independently 0, 1, 2, or 3, provided that at least one aromatic ring contains an $R^1$ substituent and that the total number of carbon atoms in all $R^1$ groups is at least 7. When m is 1 or greater, one of the X groups can be hydrogen. In one embodiment, M is a valence of a Mg ion or a mixture of Mg and hydrogen. Saligenin detergents are disclosed in greater detail in U.S. Pat. No. 6,310,009, with special reference to their methods of synthesis (Column 8 and Example 1) and preferred amounts of the various species of X and Y (Column 6).

Salixarate detergents are overbased materials that can be represented by a compound comprising at least one unit of formula (I) or formula (II) and each end of the compound having a terminal group of formula (III) or (IV):

(I)

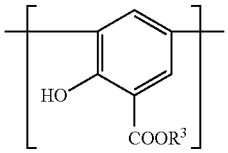

(II)

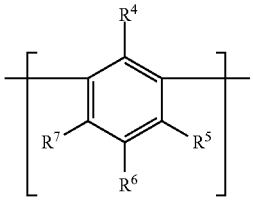

-continued (III)

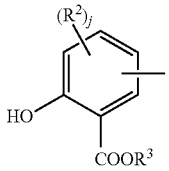

(IV)

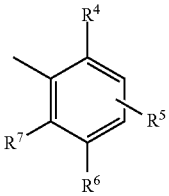

such groups being linked by divalent bridging groups A, which may be the same or different. In formulas (I)-(IV) $R^3$ is hydrogen, a hydrocarbyl group, or a valence of a metal ion; $R^2$ is hydroxyl or a hydrocarbyl group, and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— and —$CH_2OCH_2$—, either of which may be derived from formaldehyde or a formaldehyde equivalent (e.g., paraform, formalin). Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

Glyoxylate detergents are similar overbased materials which are based on an anionic group which, in one embodiment, may have the structure

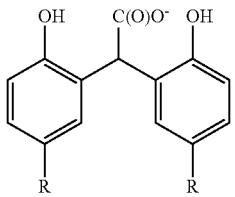

wherein each R is independently an alkyl group containing at least 4 or 8 carbon atoms, provided that the total number of carbon atoms in all such R groups is at least 12 or 16 or 24. Alternatively, each R can be an olefin polymer substituent. The acidic material upon from which the overbased glyoxylate detergent is prepared is the condensation product of a hydroxyaromatic material such as a hydrocarbyl-substituted phenol with a carboxylic reactant such as glyoxylic acid or another omega-oxoalkanoic acid. Overbased glyoxylic detergents and their methods of preparation are disclosed in greater detail in U.S. Pat. No. 6,310,011 and references cited therein.

The overbased detergent can also be an overbased salicylate, e.g., an alkali metal or alkaline earth metal salt of a substituted salicylic acid. The salicylic acids may be hydrocarbyl-substituted wherein each substituent contains an average of at least 8 carbon atoms per substituent and 1 to 3 substituents per molecule. The substituents can be polyalkene substituents. In one embodiment, the hydrocarbyl substituent group contains 7 to 300 carbon atoms and can be an alkyl group having a molecular weight of 150 to 2000. Overbased salicylate detergents and their methods of preparation are disclosed in U.S. Pat. Nos. 4,719,023 and 3,372,116. Salicylate detergents and overbased salicylate detergents may be prepared in at least two different manners. Carbonylation (also referred to as carboxylation) of a p-alkylphenol is described in many references including U.S. Pat. No. 8,399,388. Carbonylation may be followed by overbasing to form overbased salicylate detergent. Suitable p-alkylphenols include those with linear and/or branched hydrocarbyl groups of 1 to 60 carbon atoms. Salicylate detergents may also be prepared by alkylation of salicylic acid, followed by overbasing, as described in U.S. Pat. No. 7,009,072. Salicylate detergents prepared in this manner, may be prepared from linear and/or branched alkylating agents (usually 1-olefins) containing 6 to 50 carbon atoms, 10 to 30 carbon atoms, or 14 to 24 carbon atoms. In one embodiment, the overbased detergent of the invention is a salicylate detergent. In one embodiment, the salicylate detergent of the invention is free of unreacted p-alkylphenol (i.e. contains less than 0.1 weight percent). In one embodiment, the salicylate detergent of the invention is prepared by alkylation of salicylic acid Other overbased detergents can include overbased detergents having a Mannich base structure, as disclosed in U.S. Pat. No. 6,569,818.

In certain embodiments, the hydrocarbyl substituents on hydroxy-substituted aromatic rings in the above detergents (e.g., phenate, saligenin, salixarate, glyoxylate, or salicylate) are free of or substantially free of $C_{12}$ aliphatic hydrocarbyl groups (e.g., less than 1%, 0.1%, or 0.01% by weight of the substituents are $C_{12}$ aliphatic hydrocarbyl groups). In some embodiments such hydrocarbyl substituents contain at least 14 or at least 18 carbon atoms.

The amount of the overbased detergent, in the formulations of the present technology, is typically 0.05 to 1.8 percent by weight, or 0.07 to 1.5, or 0.1 to 1.2, or 0.3 to 1 percent by weight. Either a single detergent or multiple detergents can be present; if more than one is present, the amounts will relate to the total of the multiple detergents. The amount of the overbased metal detergent or detergents, combined with their TBNs, in the disclosed technology, will be restricted such that the TBN of the overall lubricant will be less than 6.5 mg KOH equivalent/g. This value will include TBN provided from the detergent as well as from other sources such as amine-containing dispersants. In certain embodiments the TBN of the lubricant will be 2 to 6 or 3 to 5.

Additional conventional components may be used in preparing a lubricant according to the present invention, for instance, those additives typically employed in a crankcase lubricant. Crankcase lubricants may typically contain any or all of the following components hereinafter described.

Another additive may be a dispersant other than a succinimide dispersant. One such alternative dispersant is high molecular weight esters, prepared by reaction of a hydrocarbyl acylating agent and a polyhydric aliphatic alcohol such as glycerol, pentaerythritol, or sorbitol. Such materials are described in more detail in U.S. Pat. No. 3,381,022. Another class of dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Such dispersants can also be post-treated by reaction with any of a variety of agents, as described above for the succinimide dispersant. The amount of the optional additional dispersant in the disclosed composition can typically be 0 to 10 weight percent, or 1 to 5 percent or 2 to 4 percent.

Another component is an antioxidant. Antioxidants encompass phenolic antioxidants, which may comprise a butyl substituted phenol containing 2 or 3 t-butyl groups. The para position may also be occupied by a hydrocarbyl group, an ester-containing group, or a group bridging two aromatic rings. Antioxidants also include aromatic amine, such as nonylated diphenylamines or alkylated phenylnaphthylamine. Other antioxidants include sulfurized olefins, titanium compounds, and molybdenum compounds. U.S. Pat. No. 4,285,822, for instance, discloses lubricating oil compositions containing a molybdenum and sulfur containing composition. U.S. Patent Application Publication 2006-0217271 discloses a variety of titanium compounds, including titanium alkoxides and titanated dispersants, which materials may also impart improvements in deposit control and filterability. Other titanium compounds include titanium carboxylates such as neodecanoate. If a titanium compound is present, its amount may be such as to provide 15 to 1000 or 25 to 200 parts per million titanium. Typical amounts of antioxidants will, of course, depend on the specific antioxidant and its individual effectiveness, but illustrative total amounts can be 0.01 to 5 percent by weight or 0.15 to 4.5 percent or 0.2 to 4 percent. Additionally, more than one antioxidant may be present, and certain combinations of these can be synergistic in their combined overall effect.

Another additive is an antiwear agent. Examples of antiwear agents include phosphorus-containing antiwear/extreme pressure agents such as metal thiophosphates, phosphoric acid esters and salts thereof, phosphorus-containing carboxylic acids, esters, ethers, and amides; and phosphites. In certain embodiments a phosphorus antiwear agent may be present in an amount to deliver 0.01 to 0.2, or 0.015 to 0.15, or 0.02 to 0.1, or 0.025 to 0.08 percent phosphorus. Often the antiwear agent is a zinc dialkyldithiophosphate (ZDP). For a typical ZDP, which may contain 11 percent P (calculated on an oil free basis), suitable amounts may include 0.09 to 0.82 percent. In one embodiment, the lubricant composition is free or substantially free of a zinc dialkyldithiophosphate. Non-phosphorus-containing anti-wear agents include borate esters (including borated epoxides), dithiocarbamate compounds, molybdenum-containing compounds, and sulfurized olefins.

Other materials that may be used as antiwear agents include tartrate esters, tartramides, and tartrimides. Examples include oleyl tartrimide (the imide formed from oleylamine and tartaric acid) and oleyl diesters (from, e.g., mixed C12-16 alcohols). Other related materials that may be useful include esters, amides, and imides of other hydroxycarboxylic acids in general, including hydroxy-polycarboxylic acids, for instance, acids such as tartaric acid, citric acid, lactic acid, glycolic acid, hydroxy-propionic acid, hydroxyglutaric acid, and mixtures thereof. These materials may also impart additional functionality to a lubricant beyond antiwear performance. These materials are described in greater detail in US Publication 2006-0079413 and PCT publication WO2010/077630. Such derivatives of (or compounds derived from) a hydroxy-carboxylic acid, if present, may typically be present in the lubricating composition in an amount of 0.1 weight % to 5 weight %, or 0.2 weight % to 3 weight %, or greater than 0.2 weight % to 3 weight %.

Other additives that may optionally be used in lubricating oils include pour point depressing agents, extreme pressure agents, anti-wear agents, color stabilizers and anti-foam agents.

Other Viscosity Modifiers

The oil of lubricating viscosity will generally be selected so as to provide, among other properties, an appropriate viscosity (both kinematic viscosity and high temperature high shear viscosity) and viscosity index. Most modern engine lubricants are multigrade lubricants which contain viscosity index improvers to provide suitable viscosity at both low and high temperatures, that is, a viscosity modifier other than the dispersant viscosity modifier (containing the nitrogen functionality) as described above, that is to say, a supplemental viscosity modifier. While the viscosity modifier is sometimes considered a part of the base oil, it is more properly considered as a separate component, the selection of which is within the abilities of the person skilled in the art.

Viscosity modifiers generally are polymeric materials which are often hydrocarbon-based polymers generally having number average molecular weights between 25,000 and 500,000, e.g., between 50,000 and 300,000 or 50,000 and 200,000.

Hydrocarbon polymers can be used as viscosity index improvers. Examples include homopolymers and polymers of two or more monomers of C2 to C30, e.g., C2 to C8 olefins, including both alphaolefins and internal olefins, which may be straight or branched, aliphatic, aromatic, alkyl-aromatic, or cycloaliphatic. Examples include ethylene-propylene copolymers, generally referred to as OCP's, prepared by copolymerizing ethylene and propylene by known processes.

Hydrogenated styrene-conjugated diene copolymers or hydrogenated conjugated diene polymers are other classes of viscosity modifiers. These polymers include polymers which are hydrogenated or partially hydrogenated homopolymers, and also include random, tapered, star, and block interpolymers. The term "styrene" includes various substituted styrenes. The conjugated diene may contain four to six carbon atoms and may include, e.g., piperylene, 2,3-dimethyl-1,3-butadiene, chloroprene, isoprene, and 1,3-butadiene. Mixtures of such conjugated dienes are useful. The styrene content of these copolymers may be 20% to 70% by weight or 40% to 60%, and the aliphatic conjugated diene content may be 30% to 80% or 40% to 60%. These copolymers can be prepared by methods well known in the art and are typically hydrogenated to remove a substantial portion of their olefinic double bonds.

Esters obtained by copolymerizing styrene and maleic anhydride in the presence of a free radical initiator and thereafter esterifying the copolymer with a mixture of C4-18 alcohols also are useful as viscosity modifying additives in motor oils. Likewise, poly(meth)acrylates (PMA) may be used as viscosity modifiers. As used herein, the term "(meth) acrylate" and its cognates means either methacrylate or acrylate, as will be readily understood. These materials are typically prepared from mixtures of (meth)acrylate monomers having different alkyl groups, which may be either straight chain or branched chain groups containing 1 to 18 carbon atoms.

Certain viscosity modifiers may be multi-armed polymers. These may include (meth)acrylate-containing polymers comprising a multiplicity of arms which contain at least about 20, or at least 50 or 100 or 200 or 350 or 500 or 1000, carbon atoms, said arms being attached to a multivalent organic moiety. The multi-armed polymer may thus be characteristic of a "star" polymer, a "comb" polymer, or a polymer otherwise having multiple arms or branches as described herein.

Star polymers are known. They may be prepared by a number of routes, including atom transfer radical polymerization (ATRP), reversible addition-fragmentation chain transfer (RAFT) polymerization, nitroxide mediated polymerization, or anionic polymerization. A detailed discussion of ATRP is given in Chapter 11, pages 523 to 628 of the *Handbook of Radical Polymerization*, Edited by Krzysztof Matyj aszewski and Thomas P. Davis, John Wiley and Sons, Inc., 2002 (hereinafter referred to as "Matyjaszewski"). See in particular reaction scheme 11.1 on page 524, 11.4 on page 556, 11.7 on page 571, 11.8 on page 572, and 11.9 on page 575.

RAFT polymerization may be employed when the core portion of the polymer contains a functional group of formula (I) above wherein Y is represented by —S—C(=S)—$R^5$ where $R^5$ may be an alkyl radical containing 1 to 20 carbon atoms. The Y functionality may be derived from or be a portion of a chain transfer agent. In certain embodiments the core portion comprises a functional group (often from a chain transfer agent) derived from a compound comprising a thiocarbonyl thio group and a free radical leaving groups, such as those disclosed in paragraph 0146 of U.S. Application 2007/0244018.

Examples of RAFT chain transfer agents include benzyl 1-(2-pyrrolidinone)carbodithioate, benzyl (1,2-benzenedicarboximido)carbodithioate, 2-cyanoprop-2-yl 1-pyrrolecarbodithioate, 2-cyanobut-2-yl 1-pyrrolecarbodithioate, benzyl 1-imidazolecarbodithioate, N,N-dimethyl-S-(2-cyanoprop-2-yl)dithiocarbamate, N,N-diethyl-S-benzyl dithiocarbamate, cyanomethyl 1-(2-pyrrolidone)carbodithoate, cumyl dithiobenzoate, N,N-diethyl S-(2-ethoxycarbonylprop-2-yl)dithiocarbamate, O-ethyl-S-(1-phenylethyl)xanthtate, O-ethyl-S-(2-(ethoxycarbonyl)prop-2-yl)xanthate, O-ethyl-S-(2-cyanoprop-2-yl)xanthate, O-ethyl-S-(2-cyanoprop-2-yl)xanthate, O-ethyl-S-cyanomethyl xanthate, O-phenyl-S-benzyl xanthate, O-pentafluorophenyl-S-benzyl xanthate, 3-benzylthio-5,5-dimethylcyclohex-2-ene-1-thione or benzyl 3,3-di(benzylthio)prop-2-enedithioate, S,S'-bis-(α,α'-disubstituted-α"-acetic acid)-trithiocarbonate, S,S'-bis-(α,α'-disubstituted-α"-acetic acid)-trithiocarbonate or S-alkyl-S'-(-(α,α'-disubstituted-α"-acetic acid)-trithiocarbonates, dithiobenzoic acid, 4-chlorodithiobenzoic acid, benzyl dithiobenzoate, 1-phenylethyl dithiobenzoate, 2-phenylprop-2-yl dithiobenzoate, 1-acetoxyethyl dithiobenzoate, hexakis(thiobenzoylthiomethyl)benzene, 1,4-bis(thiobenzoylthiomethyl)benzene, 1,2,4,5-tetrakis(thiobenzoylthiomethyl)benzene, 1,4-bis-(2-(thiobenzoylthio)prop-2-yl)benzene, 1-(4-methoxyphenyl)ethyl dithiobenzoate, benzyl dithioacetate, ethoxycarbonylmethyl dithioacetate, 2-(ethoxycarbonyl)prop-2-yl dithiobenzoate, 2,4,4-trimethylpent-2-yl dithiobenzoate, 2-(4-chlorophenyl)prop-2-yl dithiobenzoate, 3-vinylbenzyl dithiobenzoate, 4-vinylbenzyl dithiobenzoate, S-benzyl diethoxyphosphinyldithioformate, tert-butyl trithioperbenzoate, 2-phenylprop-2-yl 4-chlorodithiobenzoate, 2-phenylprop-2-yl 1-dithionaphthalate, 4-cyanopentanoic acid dithiobenzoate, dibenzyl tetrathioterephthalate, dibenzyl trithiocarbonate, carboxymethyl dithiobenzoate or poly(ethylene oxide) with dithiobenzoate end group or mixtures thereof. RAFT polymerization is also described in greater detail in Chapter 12, pages 629 to 690 of Matyjaszewski, especially pages 664 to 665.

When the (meth)acrylate-containing polymer comprising a multiplicity of arms is a star polymer, the polymer may comprise (i) a core portion comprising a polyvalent (meth) acrylic monomer, oligomer or polymer thereof or a polyvalent divinyl non-acrylic monomer, oligomer or polymer thereof; and (ii) at least two arms of polymerized alkyl (meth)acrylate ester. The core portion may then further comprise a functional group of formula (Ia):

(Ia)

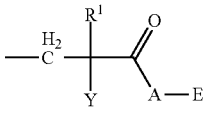

wherein E is independently another part of the core, a polymeric arm or to a monomeric species, or another structural unit as defined by formula (Ia); $R^1$ is hydrogen or a linear or branched alkyl group containing 1 to 5 carbon atoms; A is nitrogen or oxygen; and Y is a free radical leaving group selected from the group consisting of one or more atoms or groups of atoms which may be transferred by a radical mechanism under the polymerization conditions, a halogen, a nitroxide group, or a dithio ester group. Analogous to structure (Iz), the bond shown at the left of structure (Ia) may typically be attached to a Z group, where Z is a polymeric group such as a crosslinked polymeric group.

The arms of the star polymer may themselves be (meth) acrylate-containing polymer or oligomer moieties, comprising (meth)acrylic moieties condensed with alcohol moieties to provide alkyl groups. In certain embodiments, the arms of the star polymer may be formed from alkyl (meth)acrylate esters containing up to 40 carbon atoms in the alkyl group, or up to 30 carbon atoms, or 1 to 18 carbon atoms, or 1 to 15 carbon atoms, or 8 to 15, or 10 to 15, or 12 to 15 carbon atoms. In certain embodiments, one or more of the arms comprises units derived from alkyl acrylate monomers. In one embodiment the (meth)acrylate ester contains 98% to 100% of the alkyl groups in the polymerized alkyl (meth) acrylate ester arms which contain 1 to 18 or 1 to 15 carbon atoms; and 0% to 2% of alkyl groups in the polymerized alkyl (meth)acrylate ester arms which contain 19 to 30 or 16 to 30 carbon atoms.

In one embodiment the star polymer may have at least 3 arms, in another embodiment greater than 5 arms, in another embodiment greater than 7 arms, in another embodiment greater than 10 arms, for instance 12 to 100, 14 to 50, or 16 to 40 arms. In one embodiment the star polymer may have 120 arms or less, in another embodiment 80 arms or less, in another embodiment 60 arms or less. In certain embodiments there may be 3 to 20, 5 to 20, or 6 to 15, or 7 to 8 arms per star. Such multi-armed polymers and their preparation are described in greater detail in WO2015/142482, Sep. 24, 2015, see in particular paragraphs 0017 through 0064.

The amount of the viscosity modifier component (other than the dispersant viscosity modifier described above) may be 0.02 to 5 percent by weight, or 0.1 to 2 percent, or 0.2 to 1 percent, or 0.3 to 0.6 percent by weight, on an oil-free basis.

The combination of the oil of lubricating viscosity, the dispersant viscosity modifier described hereinabove, and any optional additional viscosity modifier may be selected so that the kinematic viscosity of the resulting lubricant at 100° C. will be 3.5 to 16.3 $mm^2 s^{-1}$. Moreover, these parameters may be selected such that the lubricant formulation will have a high-temperature high-shear (HTHS) viscosity per ASTM D4683 of 1.4 to 3.5 mPa-s, or 1.5 to 3.3 mPa-s, or either 1.4 or 1.5 up to 3.0 or 2.9 or 2.7 mPa-s. Lubricants with HTHS in this range are characteristic of lubricants for automotive gasoline engines, as contrasted, for example, with lubricants for heavy duty diesel engines. This range of HTHS may be obtained by selection of a base oil in the viscosity range described above along with selection of the proper viscosity modifiers, such as the above-described dispersant viscosity modifiers. The efficacy of the disclosed dispersant viscosity modifiers, in providing dispersancy, permits the amount of conventional dispersant to be reduced below previously-used levels. This, in turn, permits the use of base oils of lower kinematic viscosity, which improves cold-crank and deposit performance.

In certain embodiments the disclosed lubricant may comprising at least one of a molybdenum-containing compound, a magnesium-containing detergent, a salicylate detergent, or a borated dispersant.

As used herein, the term "condensation product" is intended to encompass esters, amides, imides and other such materials that may be prepared by a condensation reaction of an acid or a reactive equivalent of an acid (e.g., an acid halide, anhydride, or ester) with an alcohol or amine, irrespective of whether a condensation reaction is actually performed to lead directly to the product. Thus, for example, a particular ester may be prepared by a transesterification reaction rather than directly by a condensation reaction. The resulting product is still considered a condensation product.

The amount of each chemical component described is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The invention herein is useful for lubricant formulations exhibiting good dispersancy (i.e., good sludge performance) among other benefits, which may be better understood with reference to the following examples.

EXAMPLES

Polymers are prepared by reacting an ethylene/propylene copolymer or a polyisobutene with maleic anhydride under known grafting conditions, by grafting in an extrusion process or in solution, as described above, except as otherwise indicated. The acid containing polymers are first reacted with Amine A thereafter Amine B, as identified in Table 1. In the table $M_w$ and $M_n$ are reported for the amine-reacted polymers.

TABLE 1

| Dispersant polymer # | Base polymer | Amine A | Amine B | Ratio[e] | % N in polymer | $M_w$ | $M_n$ |
|---|---|---|---|---|---|---|---|
| 1 | E/P 1 [b] | 3-nitro-aniline | DMAPA[f] | 2:1:0.15 | 0.8 | 130,000 | 50,700 |
| 2 | E/P 1 | 4-methoxy-aniline | DMAPA | 2:1:0.15 | 0.47 | 102,000 | 46,800 |
| 3 | E/P 1 | aniline | DMAPA | 2:1:0.15 | 0.47 | 110,000 | 47,600 |
| 4 | E/P 1 | benzyl amine | DMAPA | 2:1:0.15 | 0.47 | 101,000 | 44,800 |
| 5 | E/P 1 | ADPA[g] | DMAPA | 2:1:0.15 | 0.82 | 106,000 | 45,000 |
| 6 | E/P 1 | disperse orange 3 | DMAPA | 2:1:0.15 | 1.52 | 201,000 | 51,500 |
| 7 | E/P 1 | aminopropyl morpholine | DMAPA | 2:1:0.15 | 0.85 | 104,000 | 44,400 |
| 8 | E/P 1 | DMAPA | DMAPA | 2:1:0.15 | 0.84 | 105,000 | 45,400 |
| 9 | E/P 1 | 3-nitro-aniline | DMAPA | 2:0.5:0.5 | 0.73 | — | — |
| 10 | E/P 2 [c] | 3-nitro-aniline | disperse orange 3 | 2:0.85:0.15 | 1.15 | 23,800 | 9,870 |
| 11 | E/P 2 | ADPA | —$CH_2$— coupled ADPA | 0.7:0.3:0.38 | 1.0 | — | 11,000 |
| 12[a] | — | — | — | — | — | — | — |
| 13 | PiB [d] | 3-nitro-aniline | Polyethylene polyamines | 2:0.7:0.3 | 1.4 | — | — |

[a]A commercial polymer "Hitech ™ 5777", purchased; for reference.

[b] E/P 1 is an ethylene propylene copolymer with 41 weight % ethylene, a reactive equivalent weight (i.e., 56100/Total Acid Number) of 3534, grafted with maleic anhydride.

[c] E/P 2 is similar to E/P 1 except having a reactive equivalent weight of 2761.

[d] PiB is polyisobutene grafted with maleic anhydride.

[e]Mole ratio CO:($NH_2$ of amine A):($NH_2$ of amine B)

[f]DMAPA = dimethylaminopropylamine

[g]ADPA = aminodiphenylamine

— information not available

Certain of the foregoing polymers are incorporated into a lubricant formulation and subjected to testing. The lubricants contain the amount and type of dispersant polymer as shown in the table below, and each also contains the following components, as weight percent (oil-free), except as otherwise indicated:

Mineral oil (API group II): 85.8%

Viscosity modifier, ethylene/propylene copolymer: 0.38%

Pour point depressant, styrenic/ester polymer, 0.07%

Sodium arenesulfonate detergent(s), 0.16% (TBN of 448 for a material incl. 36% oil)

Calcium arenesulfonate detergent(s), 0.74% (TBN of 300 for a material incl. 42% oil)

Succinimide dispersant(s), 1.1% (TBN of 15 for a material incl. 47% oil)

Antioxidants: amine, phenolic, and sulfur containing: 1.45%

Zinc dialkyldithiophosphate(s): 0.79%

Amide friction modifier: 0.1%

Commercial antifoam agent, 90 ppm including diluent

Diluent oil: balance to =100%

Viscosity parameters of lubricants, as above, containing the resulting dispersant polymers are measured according to the indicated ASTM procedures. Water tolerance is evaluated by holding a sample of the lubricant under warm and humid conditions (50° C. and 95% relative humidity) for up to 8 weeks (56 days). Turbidity of the lubricant, expressed in JTU Turbidity Units at day 0 and after a number of days is measured. The results are presented in Table 2

TABLE 2

| Ex. | Dispersant Polymer #, % | KV_100[a] | HTHS[b] | CCS[c] | Turbidity, JTU day 0 | Turbidity, JTU day 56 or as noted | Change in JTU |
|---|---|---|---|---|---|---|---|
| 0* | 0% | 10.75 | 3.19 | 5080 | 16.7 | 102 (42 days) | 85.3 |
| 1 | 1, 0.5% | 10.59 | 3.16 | 4580 | 22 | 40 | 18 |
| 2 | 2, 0.5% | 10.07 | 2.97 | 4990 | 14 | 21 | 7 |
| 3 | 3, 0.5% | 10.63 | 2.98 | 5030 | 13.4 | 22 | 8.6 |
| 4 | 4, 0.5% | 10.02 | 2.98 | 4980 | 15.8 | 38 | 22.2 |
| 5 | 5, 0.5% | 10.22 | 2.98 | 5040 | 15.6 | 38 | 22.4 |
| 6 | 6, 0.5% | 11.87 | 3.08 | 5050 | 21 | 38 | 17 |
| 7 | 7, 0.5% | 10.07 | 2.97 | 5060 | 14 | 28 | 14 |
| 8 | 8, 0.5% | 10.25 | 2.98 | 5080 | 12.7 | 29 | 16.3 |
| 9 | 10, 0.5% | 9.43 | — | — | 17.6 | 105 | 87.4 |
| 10 | 10, 0.67% | 9.74 | — | — | 17 | 14.2[d] | −3 |
| 11 | 11, 0.5% | 9.62 | — | — | 15.5 | 93 | 77.5 |
| 12* | 12, 0.56% | 10.64 | 2.87 | 3580 | 17.6 | 128 (14 days) | 110.4 |

*reference or comparative example
[a]KV_100 in $mm^2s^{-1}$ as measured by ASTM D2270
[b]HTHS viscosity in mPa-s as measured by ASTM D4683
[c]Cold Crank Shear viscosity in mPa-s as measured by ASTM D4683
[d]Some sedimentation observed, leading to decrease in JTU The results show that the polymers of the present invention impart good clarity (acceptable turbidity) upon long term hot exposure to water, and good viscosity characteristics.

Series III G deposit performance testing and Series VG sludge deposit testing performance are conducted on lubricant formulations containing Dispersant Polymer #1, defined above, with reduced amounts of conventional dispersant. The compositions are generally the same or comparable to those used for Table 2, with significant changes being noted in below. Amounts are percent, oil-free:

TABLE 3

| Example | 12 (ref) | 13 |
|---|---|---|
| Dispersant Polymer 1 | 0 | 0.5 |
| Conventional succinimide dispersant | 2 | 1 |
| Conventional olefin copolymer viscosity modifier | 0.65 | 0.38 |
| Results: | | |
| IIIG Weighted Piston Deposit Rating | 4.69 | 4.55 |

TABLE 4

| Example | 14 (ref) | 15 |
|---|---|---|
| Dispersant Polymer 1 | 0 | 0.5 |
| Conventional succinimide dispersant | 1.83 | 0.83 |
| Conventional olefm copolymer viscosity modifier | 0.79 | 0.55 |
| Pour point depressant (described above) | 0.07 | 0 |
| Pour point depressant (different) | 0 | 0.10 |
| Results: | | |
| VG Average Engine Sludge Rating | 8.39 | 8.55 |
| VG Rocker Cover Sludge Rating | 9.58 | 9.32 |
| VG Average Engine Varnish Rating | 9.14 | 9.25 |

The deposit, sludge, and varnish ratings remain substantially unchanged even at significantly reduced amounts of conventional dispersant. The difference in pour point depressant between examples 14 and 15 will not qualitatively affect the results.

The disclosed technology may also be used for improving the water tolerance of a lubricating oil, where the lubricating oil comprises (a) an oil of lubricating viscosity; (c) 0.35 to 1.8 percent by weight of an ashless succinimide dispersant comprising the condensation product of a polyolefin-substituted succinic anhydride, with an alkylene polyamine, where the polyolefin substituent has a number average molecular weight of 1,000 to 3,500; and (d) 0.05 to 1.5 percent by weight of an overbased metal detergent, in an amount such that the total base number (TBN per ASTM D2896) of the lubricant composition is less than 6.5; by including within said lubricating oil (b) 0.25 to 1.5 percent by weight of a condensation reaction product of an olefin polymer, having a number average molecular weight (ASTM D664A) of 2,000 to 70,000 or 5,000 to 65,000, comprising carboxylic acid functionality or a reactive equivalent thereof grafted onto the polymer backbone, with a monoamine or a polyamine, provided that if the olefin polymer is an ethylene/propylene copolymer, then said polyamine has no more than one primary amino group.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as optionally modified by the word "about." It is to be understood that the upper and lower amount, range, and ratio limits set forth herein may be independently combined. Similarly, the ranges and amounts for each element of the invention can be used together with ranges or amounts for any of the other elements.

As used herein, the transitional term "comprising," which is synonymous with "including," "containing," or "characterized by," is inclusive or open-ended and does not exclude additional, un-recited elements or method steps. However, in each recitation of "comprising" herein, it is intended that the term also encompass, as alternative embodiments, the phrases "consisting essentially of" and "consisting of," where "consisting of" excludes any element or step not specified and "consisting essentially of" permits the inclusion of additional un-recited elements or steps that do not materially affect the essential or basic and novel characteristics of the composition or method under consideration. The expression "consisting of" or "consisting essentially of" when applied to an element of a claim, is intended to restrict all species of the type represented by that element, notwithstanding the presence of "comprising" elsewhere in the claim.

While certain representative embodiments and details have been shown for the purpose of illustrating the subject invention, it will be apparent to those skilled in this art that various changes and modifications can be made therein without departing from the scope of the subject invention. In this regard, the scope of the invention is to be limited only by the following claims.

What is claimed is:

1. A lubricant composition comprising:

(a) an oil of lubricating viscosity having a kinematic viscosity at 100° C. of about 2 to about 5.3 $mm^2s^{-1}$;

(b) about 0.14 to about 1.5 percent by weight of an ashless condensation reaction product of an olefin polymer, having a number average molecular weight (GPC) of about 2,000 to about 70,000, comprising carboxylic acid functionality or a reactive equivalent thereof grafted onto the polymer backbone, with 3-nitroaniline;

(c) about 0.35 to about 1.8 percent by weight of a succinimide dispersant comprising the condensation product of a polyolefin-substituted succinic anhydride, with an alkylene polyamine, where the polyolefin substituent has a number average molecular weight of about 1,000 to about 3500; and (d) about 0.05 to about 1.5 percent by weight of an overbased metal detergent, in an amount such that the total base number (TBN per ASTM D2896) of the lubricant composition is less than about 6.5;

said lubricant composition having a high-temperature high-shear viscosity per ASTM D4683 of about 1.4 to about 3.5 mPa-s.

2. The lubricant composition of claim 1 wherein the amount of the ashless condensation reaction product is about 0.4 to about 1 percent by weight.

3. The lubricant composition of claim 1, wherein the olefin polymer comprises an ethylene/propylene copolymer backbone with grafted succinic anhydride functionality.

4. The lubricant of claim 1, wherein the ashless condensation product of (b) is further condensed with an aliphatic amine.

5. The lubricant of claim 1, wherein the ashless condensation product of (b) has a nitrogen content of about 0.4 to about 1.6 percent by weight.

6. The lubricant of claim 1, wherein the amount of the succinimide dispersant is about 0.5 to about 1.5 percent by weight.

7. The lubricant of claim 1, wherein the succinimide dispersant comprises a condensation product of a polyisobutene-substituted succinic anhydride.

8. The lubricant of claim 1, wherein the succinimide dispersant has a total base number (ASTM D2896) of about 10 to about 60, as calculated on an oil-free basis.

9. The lubricant of claim 1, wherein the amount of the overbased metal detergent is about 0.5 to about 1 percent by weight.

10. The lubricant of claim 1, wherein the overbased metal detergent comprises an overbased metal alkylsulfonate.

11. The lubricant of claim 1, wherein the overbased metal detergent comprises an overbased sodium alkylsulfonate.

12. The lubricant of claim 11, further comprising an overbased calcium alkylsulfonate.

13. The lubricant of claim 1, comprising at least one of a molybdenum-containing compound, a magnesium-containing detergent, a salicylate detergent, or a borated dispersant.

14. A lubricant composition comprising:

(a) an oil of lubricating viscosity having a kinematic viscosity at 100° C. of about 2 to about 5.3 $mm^2s^{-1}$;

(b) about 0.4 to about 1 percent by weight of an ashless condensation reaction product of an ethylene/propylene copolymer, having a number average molecular weight of about 5,000 to about 65,000, having succininic anhydride functionality or a reactive equivalent thereof grafted onto the polymer backbone, having a nitrogen content of about 0.4 to about 1.6 weight percent, with an aromatic amine component comprising 3-nitroaniline and an aliphatic amine;

(c) about 0.35 to about 1.5 percent by weight of a succinimide dispersant comprising the condensation product of a polyisobutene-substituted succinic anhydride, with an alkylene polyamine, where the polyolefin substituent has a number average molecular weight of about 1,000 to about 3,500, and wherein the succinimide dispersant has a total base number of about 3 to about 22 per ASTM 2896 as calculated on an oil-free basis; and (d) about 0.5 to about 1 percent by weight of an overbased metal alkylsulfonate detergent wherein the metal is one or more selected from the group consisting of sodium and calcium, in an amount such that the total base number ASTM D2896 of the lubricant composition is less than about 6.5;

said lubricant composition having a high-temperature high-shear viscosity per ASTM D4683 of about 1.4 to about 3.5 mPa-s.

15. A method for lubricating a spark-ignited, sump-lubricated internal combustion engine by supplying thereto a lubricant composition comprising:

(a) an oil of lubricating viscosity having a kinematic viscosity at 100° C. of about 2 to about 5.3 $mm^2s^{-1}$;

(b) about 0.25 to about 1.5 percent by weight of an ashless condensation reaction product of an olefin polymer, having a number average molecular weight (ASTM D664A) of about 5,000 to about 65,000, comprising carboxylic acid functionality or a reactive equivalent thereof with 3-nitroaniline, the polymer backbone, with a monoamine or a polyamine provided that if the olefin polymer is an ethylene/propylene copolymer, then said polyamine is not a poly(ethyleneamine);

(c) about 0.35 to about 1.8 percent by weight of a succinimide dispersant comprising the condensation product of a polyolefin-substituted succinic anhydride, with an alkylene polyamine, where the polyolefin substituent has a number average molecular weight of about 1,000 to about 3500; and (d) about 0.05 to about 1.5 percent by weight of an overbased metal detergent such that the total base number of the composition is less than about 6.5;

wherein said lubricant composition has a high-temperature high-shear viscosity per ASTM D4683 of about 1.4 to about 3.5 mPa-s.

16. The lubricant of claim 15, wherein the overbased metal detergent comprises an overbased sodium alkylsulfonate.

* * * * *